US008176946B2

(12) United States Patent
Zhang et al.

(10) Patent No.: US 8,176,946 B2
(45) Date of Patent: May 15, 2012

(54) AUTOMATIC WIRE CUTTING AND TWISTING APPARATUS

(75) Inventors: Shao-bo Zhang, Tu Cheng (TW); Lung-chuan Chou, Tu Cheng (TW); Sung-lin Chen, Tu Cheng (TW); Xiao-lin Wu, Tu Cheng (TW); Zai-wei Zou, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 150 days.

(21) Appl. No.: 12/859,260

(22) Filed: Aug. 18, 2010

(65) Prior Publication Data

US 2012/0042984 A1 Feb. 23, 2012

(51) Int. Cl.
*B21F 15/04* (2006.01)

(52) U.S. Cl. ..... 140/118; 140/1

(58) Field of Classification Search ..... 140/1, 93.6, 140/30, 36, 39, 118–120, 139, 140
See application file for complete search history.

(56) References Cited

U.S. PATENT DOCUMENTS 5,826,629 A * 10/1998 West ..... 140/119
* cited by examiner

*Primary Examiner* — Faye Francis
(74) *Attorney, Agent, or Firm* — Cheng-Ju Chiang

(57) ABSTRACT

An automatic wire cutting and twisting apparatus includes a chassis board on which a start-terminal mounting rack, an end-terminal mounting rack, and a mounting track are mounted. The start-terminal mounting rack opposes a start terminal of the mounting track. The end-terminal mounting rack is position-adjustably coupled to an end terminal of the mounting track. A wire cutting mechanism is mounted on the start-terminal mounting rack and forms ingress and egress for wires. A wire twisting mechanism includes start-terminal and end-terminal rotation sections respectively mounted on the start-terminal and end-terminal mounting racks. A wire dragging mechanism includes a start-terminal dragging section mounted on the chassis board and a slidable dragging section movable above the mounting track. A wire pick-up mechanism is position-adjustably mounted on the mounting track. A cutting and twisting control mechanism is electrically connected to the wire cutting mechanism, the wire twisting mechanism, and the wire dragging mechanism.

8 Claims, 6 Drawing Sheets

AUTOMATIC WIRE CUTTING AND TWISTING APPARATUS

BACKGROUND OF THE INVENTION

1. Field of the Invention

The present invention generally relates to a wire cutting and twisting apparatus for cutting and twisting electrical wires, and in particular to an automatic wire cutting and twisting apparatus.

2. The Related Arts

Cutting and twisting electrical wires or cables are operations that are almost indispensable for the wire and cable industry. With the development and progress of technology, there are increasingly severe requirements for the wire cutting and twisting techniques. Some existing work shops still employs manual operations to cut and twist electrical wires, where an operator first cuts desired lengths of electrical wires by applying jigs of simple structures and then twists together two or more of the cut lengths of electrical wire. Such an operation is disadvantageous in that (1) a skilled and physically strong operator, which has been well trained for a long time is required for carrying out the cutting and twisting operation, so that this conventional process is generally labor-consuming and time-consuming, (2) electrical wires must be conveyed first for being positioned on the jigs, so that the productivity is low, and (3) the lengths of the wire cut are measured manually, so that the precision might be poor.

Thus, it is desired to have a wire cutting and twisting apparatus that is capable of automatically cutting electrical wires to ensure high operation efficiency, high cutting precision, and low operation cost.

SUMMARY OF THE INVENTION

An objective of the present invention is to overcome the problems of the conventional technology discussed above by providing an automatic wire cutting and twisting apparatus, which reduces human labor used, automatically cuts off electrical wires, and realizes precise control of the length of electrical wires so cut off.

To achieve the above objective, the present invention provides an automatic wire cutting and twisting apparatus, which comprises a chassis board, a wire cutting mechanism, a wire twisting mechanism, a wire dragging mechanism, a wire pick-up mechanism, and a cutting and twisting control mechanism. The chassis board carries a start-terminal mounting rack, an end-terminal mounting rack, and a mounting track mounted thereon. The mounting track is fixed on the chassis board. The start-terminal mounting rack is mounted on the chassis board at a location opposing a start terminal of the mounting track. The end-terminal mounting rack is coupled to an end terminal of the mounting track in a position adjustable manner. The wire cutting mechanism is mounted on the start-terminal mounting rack and the wire cutting mechanism forms wire ingress openings and the wire egress openings. The wire twisting mechanism comprises a start-terminal rotation section and an end-terminal rotation section. The start-terminal rotation section is mounted on the start-terminal mounting rack. The end-terminal rotation section is mounted on the end-terminal mounting rack. The wire dragging mechanism comprises a start-terminal dragging section and a slidable dragging section. The start-terminal dragging section is mounted on the chassis board between the start terminal of the mounting track and the start-terminal mounting rack. The slidable dragging section is slidably coupled to the chassis board and is movable above the mounting track. The wire pick-up mechanism is mounted on the mounting track in a position adjustable manner and is located between the start-terminal rotation section and the end-terminal rotation section. The cutting and twisting control mechanism is electrically connected to the wire cutting mechanism, the wire twisting mechanism, and the wire dragging mechanism to control the operations of the wire cutting mechanism, the wire twisting mechanism, and the wire dragging mechanism.

The automatic wire cutting and twisting apparatus according to the present invention is different from the existing technology in that (1) the present invention comprises a wire cutting mechanism that cuts off electrical wires in a mechanical manner and also comprises a wire twisting mechanism that twists the cut wires together so that the present invention realizes automatic cutting and twisting of electrical wires without human intervention, (2) the present invention controls the length of electrical wires cut thereby in a rough measure, where the length of the electrical wires to be cut is roughly determined by a spacing distance between a start-terminal rotation section and an end-terminal rotation section, and a precise measure, where the length is precisely determined through the movement of a slidable dragging section, of which the operation is completely mechanized so that human error occurring in the conventional process for determining the length of electrical wires to be cut is eliminated, (3) the present invention employs a start-terminal rotation section and an end-terminal rotation section to twist electrical wires, where the electrical wires are clamped between the start-terminal rotation section and the end-terminal rotation section and the start-terminal rotation section and the end-terminal rotation section are actuated to rotate in opposite directions so as to perform twisting of the electrical wires, which ensures consistent twisting pitch of the twisted wires, and (4) the present invention comprises a slidable dragging section that moves an end of the electrical wires to an end-terminal rotation section and a start-terminal dragging section that moves an opposite end of the electrical wires to a start-terminal rotation section, so that time used is reduced and efficiency is improved. Thus, the automatic wire cutting and twisting apparatus according to the present invention realizes automatic cutting and twisting of electrical wires with the length of the electrical wires so cut being precisely determined, twisting of the wires being made uniform, human labour being reduced, and efficiency being improved.

BRIEF DESCRIPTION OF THE DRAWINGS

The present invention will be apparent to those skilled in the art by reading the following description of a preferred embodiment of the present invention, with reference to the attached drawings, in which.

DETAILED DESCRIPTION OF PREFERRED EMBODIMENT

Figure 1:
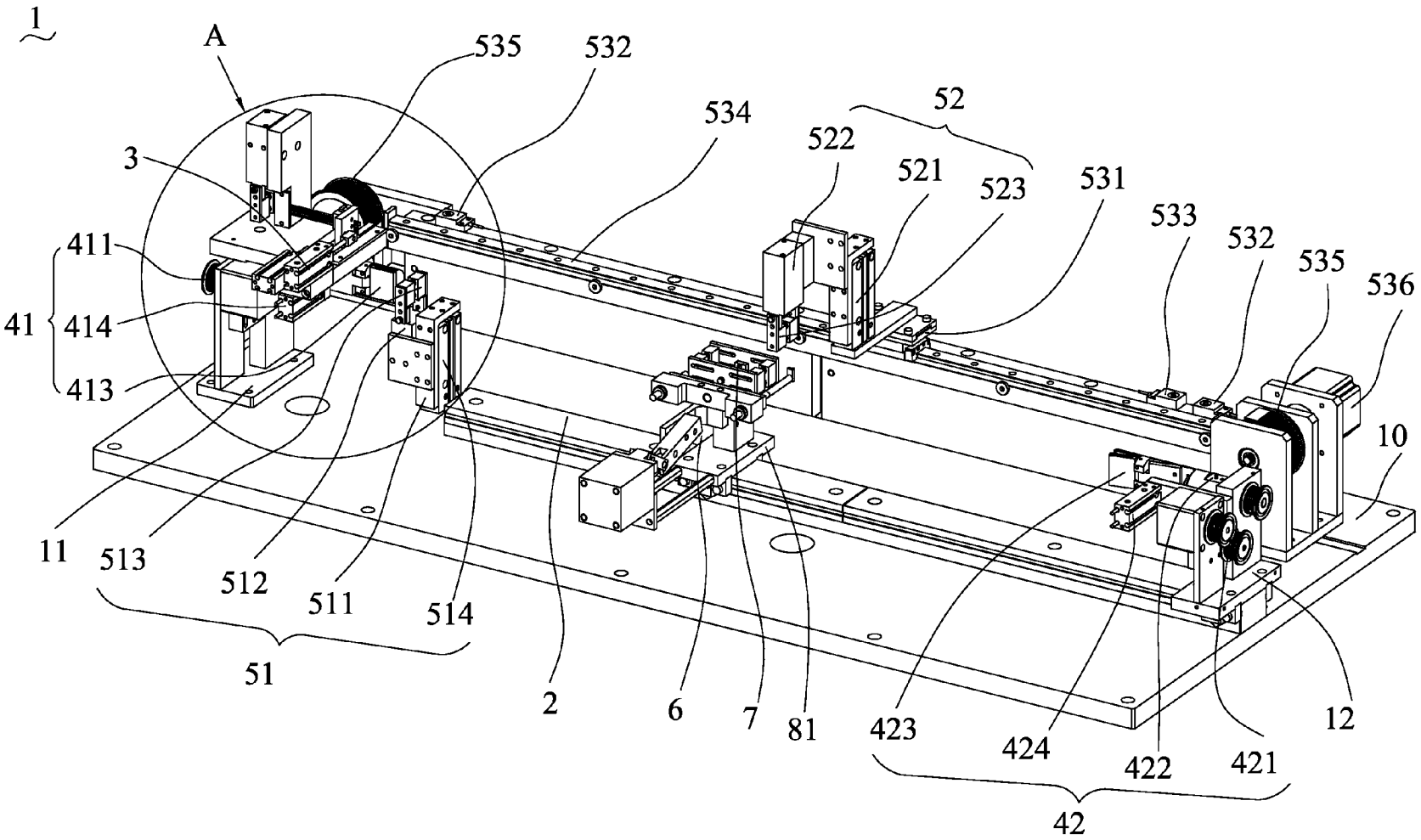
FIG. 1 is a perspective view showing an automatic wire cutting and twisting apparatus according to an embodiment of the present invention.

With reference to the drawings and in particular FIG. 1, the present invention provides an automatic wire cutting and twisting apparatus, generally designated at 1, which is used to cut and twist multiple electrical wires. The automatic wire cutting and twisting apparatus 1 comprises a chassis board 10, a wire cutting mechanism 3, a wire twisting mechanism, a wire dragging mechanism, a wire pick-up mechanism 6, and a cutting and twisting control mechanism (not shown in the drawings). The wire twisting mechanism comprises a start-terminal rotation section 41 and an end-terminal rotation section 42. The wire dragging mechanism comprises a start-terminal dragging section 51 and a slidable dragging section 52. The automatic wire cutting and twisting apparatus 1 may further comprise an intermediate clamping mechanism 7.

Figure 2:
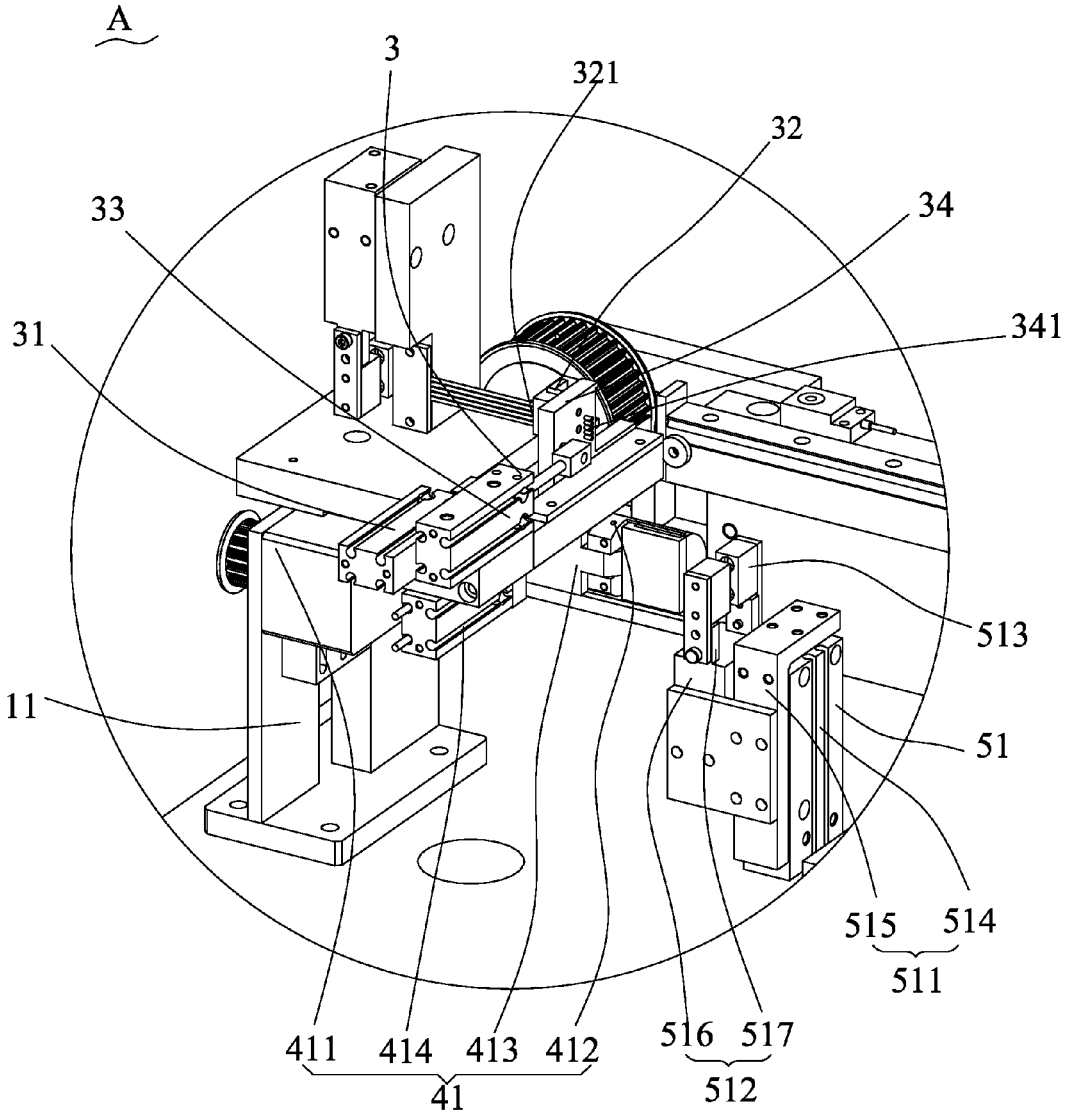
FIG. 2 is an enlarged view of a circled portion of FIG. 1 designated with reference A.
Figure 5:
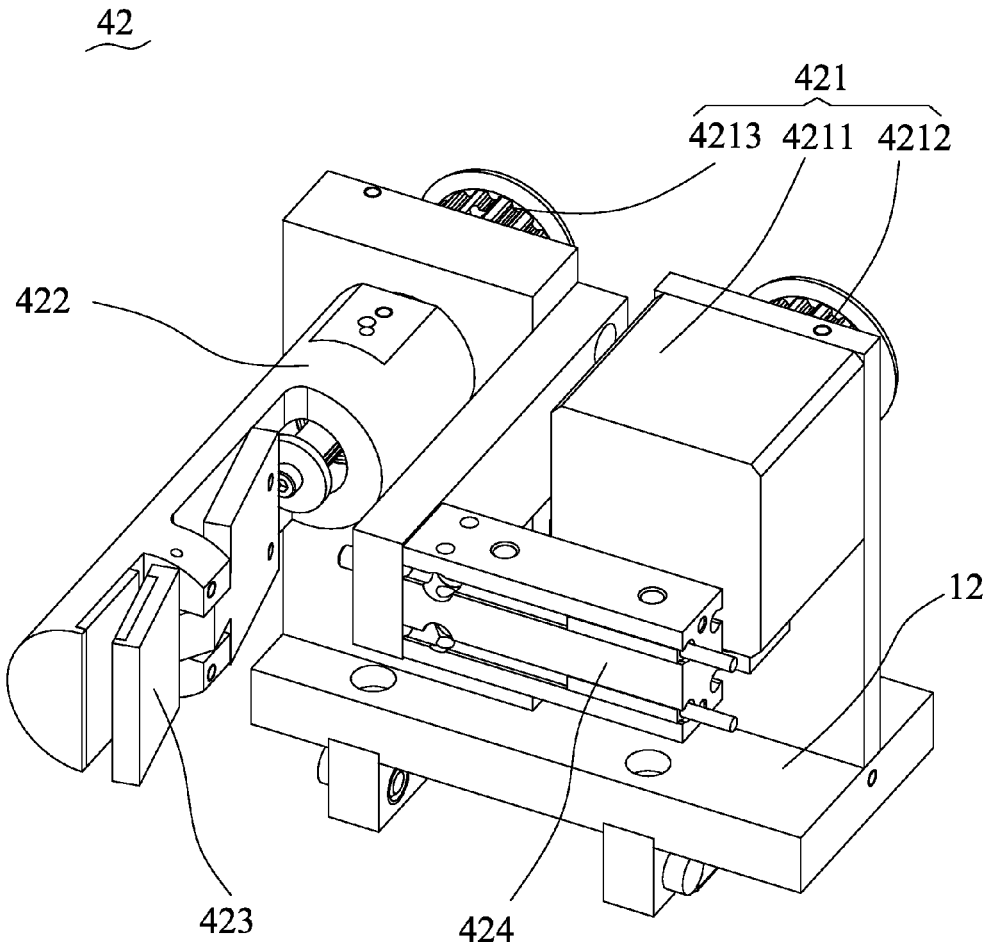
FIG. 5 is a perspective view of an end-terminal rotation section of the automatic wire cutting and twisting apparatus shown in FIG. 1.

Referring to FIGS. 1 and 2, the chassis board 10 carries a start-terminal mounting rack 11, an end-terminal mounting rack 12, and a mounting track 2 mounted thereon. The mounting track 2 is fixed on the chassis board 10. The start-terminal mounting rack 11 is mounted on the chassis board 10 at a location opposing a start terminal of the mounting track 2. The end-terminal mounting rack 12 is coupled to an end terminal of the mounting track 2 in a position adjustable manner. The start-terminal mounting rack 11, the end-terminal mounting rack 12, and the mounting track 2 are lined up along a common line with the start-terminal mounting rack 11 and the end-terminal mounting rack 12 located at the two terminals of the mounting track 2. Referring to FIG. 5, the end-terminal mounting rack 12 has a lower portions having two spaced vertical legs and located on the end terminal of the mounting track 2 in such a way that the end-terminal mounting rack 12 is releasably coupled to the mounting track 2 with fasteners. When an attempt is made to adjust the length of electrical wires to be cut, the fasteners that secure the lower portion of the end-terminal mounting rack 12 are released, and the end-terminal mounting rack 12 is moved along the mounting track 2 to a desired location, where the fasteners are tightened again to secure the end-terminal mounting rack 12 at the desired location on the mounting track 2.

Referring to FIGS. 1 and 2, the wire cutting mechanism 3 comprises a first cutter block 32, a second cutter block 34, a first extension pneumatic cylinder 31, and a second extension pneumatic cylinder 33. The first cutter block 32 and the second cutter block 34 are arranged to juxtapose each other and mounted on the start-terminal mounting rack 11. The first cutter block 32 forms wire ingress openings 321 for ingress of electrical wires and the second cutter block 34 forms wire egress openings 341 for feeding the electrical wires out of the wire cutting mechanism 3. The wire ingress openings 321 and the wire egress openings 341 are in communication with each other. The first extension pneumatic cylinder 31 is coupled to the first cutter block 32 for controlling movement of the first cutter block 32. The second extension pneumatic cylinder 33 is coupled to the second cutter block 34 for controlling movement of the second cutter block 34. To cut off electrical wires, the first extension pneumatic cylinder 31 and the second extension pneumatic cylinder 33 respectively controls the first cutter block 32 and the second cutter block 34 to move in opposite directions so as to cut off the electrical wires that extend through the wire ingress openings 321 and the wire egress openings 341.

Figure 6:
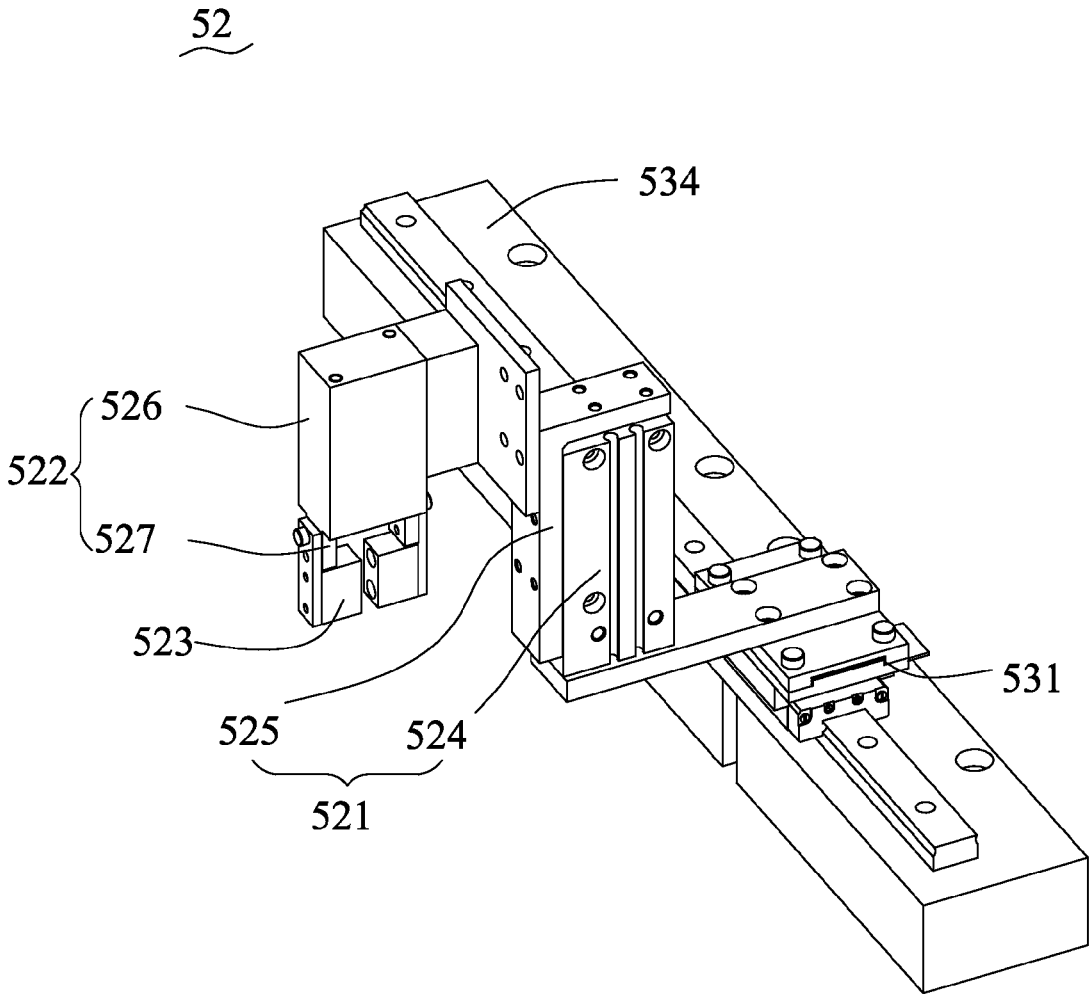
FIG. 6 is a perspective view of a slidable dragging section of the automatic wire cutting and twisting apparatus shown in FIG. 1.

Referring to FIGS. 1, 2, and 6, the wire dragging mechanism comprises a start-terminal dragging section 51 and a slidable dragging section 52. The start-terminal dragging section 51 is mounted between the start terminal of the mounting track 2 and the start-terminal rotation section 41. The slidable dragging section 52 is slidably mounted on the chassis board 10 and is movable above the mounting track 2. Specifically, the start-terminal dragging section 51 comprises an elevation cylinder 511, a clamping cylinder 512, and a wire clamp 513. The elevation cylinder 511 comprises an elevation body 514 and an elevation arm 515. The clamping cylinder 512 comprises a clamping body 516 and a clamping arm 517. The elevation body 514 is fixed to the chassis board 10 and the clamping body 516 is attached to the elevation arm 515. The wire clamp 513 is mounted to the clamping arm 517. The slidable dragging section 52 has a structure similar to the start-terminal dragging section 51 in that the slidable dragging section 52 comprises an elevation cylinder 521, a clamping cylinder 522, and a wire clamp 523. The elevation cylinder 521 comprises an elevation body 524 and an elevation arm 525. The clamping cylinder 522 comprises a clamping body 526 and a clamping arm 527. The elevation body 524 is slidably coupled to the chassis board 10. The clamping body 526 is attached to the elevation arm 525. The wire clamp 523 is mounted to the clamping arm 527. Further, the wire clamp 523 is arranged above the mounting track 2 in a downward pointing manner and is movable in unison with the elevation body 524 above the mounting track 2.

The start-terminal dragging section 51 functions to move an end of electrical wires from the wire egress openings 341 to the start-terminal rotation section 41, while the slidable dragging section 52 functions to move an opposite end of the electrical wires from the wire egress openings 341 to the end-terminal rotation section 42. With the operation of the elevation cylinder 511 of the start-terminal dragging section 51, the elevation arm 515 moves upward with respect to the elevation body 514 and the clamping cylinder 512 and the wire clamp 513 that are attached to the elevation arm 515 also move upward. Under this condition, the wire clamp 513 is set on a common horizontal plane with the wire egress openings 341, so that when the elevation cylinder 511 of the start-terminal dragging section 51 returns, the elevation arm 515 moves downward with respect to the elevation body 514, causing the clamping cylinder 512 and the wire clamp 513 to move downward. Under this condition, the wire clamp 513 is set on a common horizontal plane with a wire clip 413 of the start-terminal rotation section 41. Similarly, with the operation of the elevation cylinder 521 of the slidable dragging section 52, the wire clamp 513 is set on a common horizontal plane with the wire egress openings 341 and when the elevation cylinder 521 of the slidable dragging section 52 returns, the wire clamp 523 is set on a common horizontal plane with a wire clip 423 of the end-terminal rotation section 42.

Referring to FIGS. 1 and 6, the wire dragging mechanism further comprises a slide block 531, a servo motor 536, a slide track 534, a timing belt (not shown in the drawings), and pulleys 535. The elevation body 524 of the slidable dragging section 52 is mounted to the slide block 531, which is slidably mounted to the slide track 534. The slide track 534 is fixed to the chassis board 10 and is substantially parallel to the mounting track 2. Opposite ends of the slide track 534 are respectively provided with the pulleys 535 with the timing belt surrounding the pulleys 535. The timing belt is coupled to the slide block 531 for driving the slide block 531 to slide along the slide track 534. The opposite ends of the slide track 534 are also respectively provided with limit sensors 532, and home-position sensor 533 is arranged at a location between the limit sensors 532. The limit sensors 532 function to limit the movement of the slide block 531 along the slide track 534 and the home-position sensor 533 defines a home position for the slidable dragging section 52.

Referring to FIGS. 1, 2, and 5, the wire twisting mechanism comprises the start-terminal rotation section 41 and the end-terminal rotation section 42. The start-terminal rotation section 41 is mounted on the start-terminal mounting rack 11 and the end-terminal rotation section 42 on the end-terminal mounting rack 12. The start-terminal rotation section 41 comprises a driving portion 411, a rotation arm 412, a wire clip 413, and a pneumatic cylinder 414. The driving portion 411 is coupled to an end of the rotation arm 412 for driving rotation of the rotation arm 412. The wire clip 413 is mounted to an opposite end of the rotation arm 412. The pneumatic cylinder 414 is coupled to the wire clip 413 for controlling the wire clip 413 to selectively open and close. The end-terminal rotation section 42 is structured similar to the start-terminal rotation section 41 and comprises a driving portion 421, a rotation arm 422, a wire clip 423, and a pneumatic cylinder 424. The driving portion 421 is coupled to an end of the rotation arm 422 for driving rotation of the rotation arm 422. The wire clip 423 is mounted to an opposite end of the rotation arm 422. The pneumatic cylinder 424 is coupled to the wire clip 423 for controlling the wire clip 423 to selectively open and close. When the wire dragging mechanism moves two opposite ends of electrical wires to the start-terminal rotation section 41 and the end-terminal rotation section 42, the wire clips 413, 423 of the start-terminal rotation section 41 and the end-terminal rotation section 42 hold the two ends of the electrical wires respectively. Afterwards, the driving portions 411, 421 of the start-terminal rotation section 41 and the end-terminal rotation section 42 operate in opposite directions to respectively drive the rotation arms 412, 422 to rotate in opposite directions, making the opposite ends of the electrical wires held by the wire clips 413, 423 rotated in opposite direction thereby twisting the electrical wires together to complete the wire twisting operation.

Specifically, the driving portion 421 of the end-terminal rotation section 42 comprises a motor 4211, a driving pulley 4212, a driven pulley 4213, a tension roller, and a belt (not shown in the drawings). The motor 4211 is coupled to a shaft of the driving pulley 4212 to control the rotation of the driving pulley 4212. The belt surrounds the driving pulley 4212, the driven pulley 4213, and the tension roller, and is moved by the rotation of the driving pulley 4212 to rotate the driven pulley 4213, so that the driven pulley 4213 drives rotation of the rotation arm 412, and the rotation arm 412 drives rotation of the wire clip 423. The tension roller helps preventing slackening of the belt. The driving portion 411 of the start-terminal rotation section 41 is structured similar to the driving portion 421 of the end-terminal rotation section 42.

Figure 3:
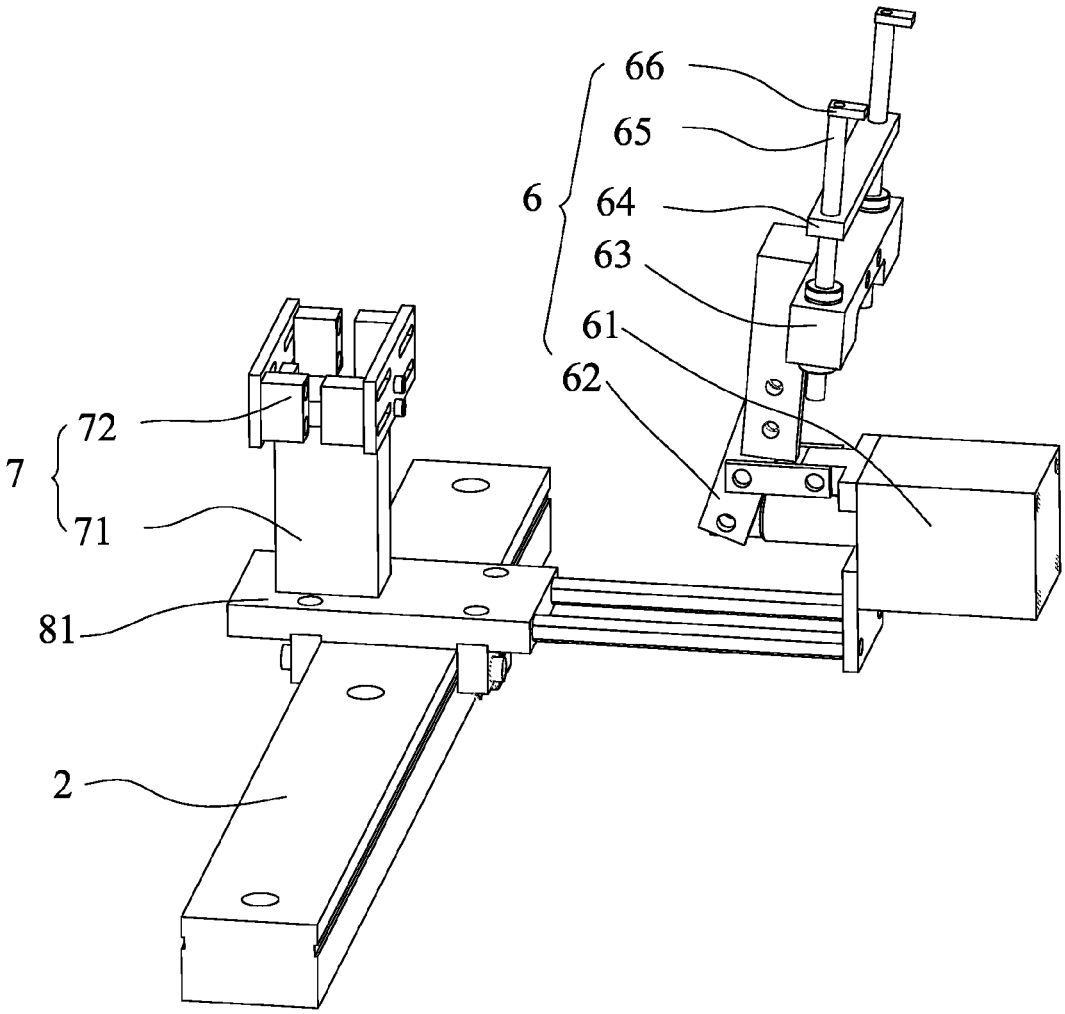
FIG. 3 is a perspective view showing an intermediate clamping mechanism and a wire pick-up mechanism of the automatic wire cutting and twisting apparatus shown in FIG. 1.
Figure 4:
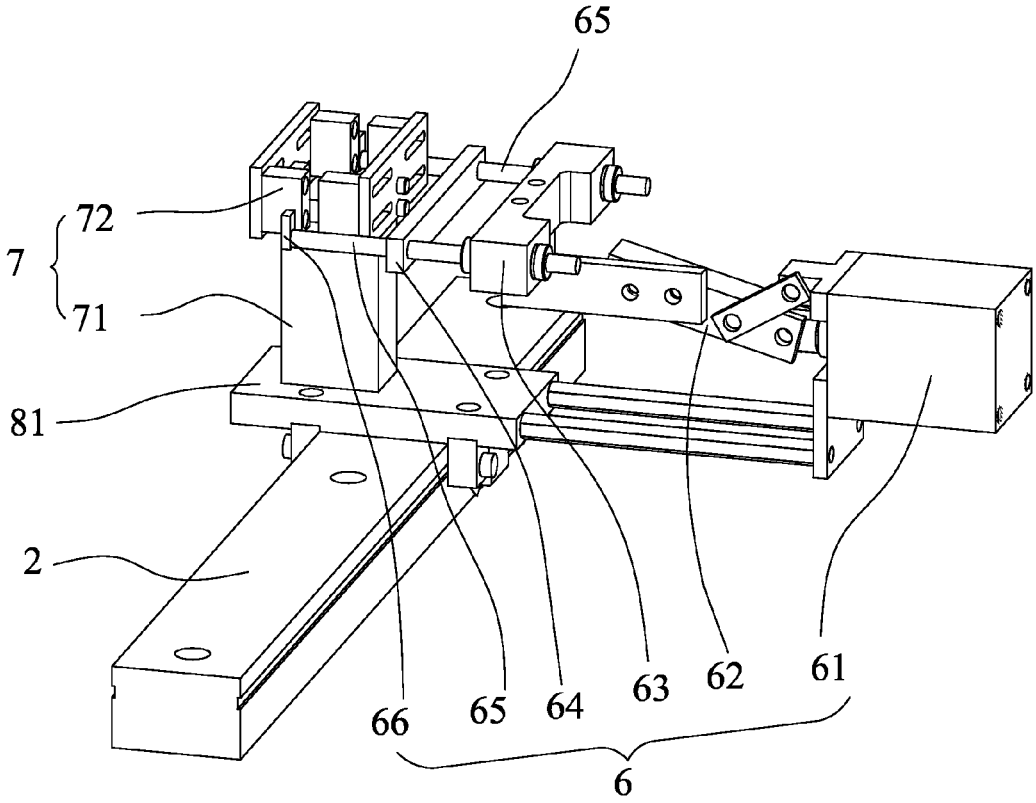
FIG. 4 is a perspective view of a turn-over arm of the wire pick-up mechanism of the automatic wire cutting and twisting apparatus shown in FIG. 1.

Referring to FIGS. 1, 3, and 4, the wire pick-up mechanism 6 comprises a mounting block 81, a turn-over pneumatic cylinder 61, a turn-over arm 62, a fixing block 63, a stop board 64, two stop blocks 66, and two wire pick-up bars 65. The mounting block 81 is mounted on the mounting track 2 in a position adjustable manner. The turn-over pneumatic cylinder 61 is fixed to the mounting block 81 and is coupled to an end of the turn-over arm 62 for selectively turning the turn-over arm 62 by a predetermined angle, such as 90 degrees. The fixing block 63 is arranged at an opposite end of the turn-over arm 62. The two wire pick-up bars 65 are mounted, at one end thereof, to opposite side portions of the fixing block 63 and extend, at an opposite end, across the mounting track 2. The two stop blocks 66 are respectively coupled to the wire pick-up bars 65 at the ends thereof distant from the fixing block 63. The stop board 64 is fixed to the wire pick-up bars 65 at a location close to the fixing block 63, whereby the two wire pick-up bars 65 define a wire pick-up zone between the fixing block 63 and the stop blocks 66. When a twisting operation of electrical wires performed by the wire twisting mechanism is just finished, the wire pick-up mechanism 6 is in a forward expanded condition as illustrated in FIG. 4. When the wire clips 413, 423 of the start-terminal rotation section 41 and the end-terminal rotation section 42 are opened, the twisted wires fall onto the wire pick-up zone of the two wire pick-up bars 65, whereby the turn-over pneumatic cylinder 61 of the wire pick-up mechanism 6 operates to drive the turn-over arm 62 for turning the two wire pick-up bars 65 upward by for example 90 degrees to convey the twisted wires to a desired location.

Referring to FIGS. 1, 3, and 4, the intermediate clamping mechanism 7 comprises a clamping cylinder 71 and a wire clamp 72. The clamping cylinder 71 comprises a clamping body and a clamping arm. The clamping body is mounted on the mounting track 2 and is coupled to the mounting block 81 of the wire pick-up mechanism 6. The clamping arm is coupled to the wire clamp 72 for controlling the operation of the wire clamp 72. Specifically, the mounting block 81 is structured comprising two spaced vertical legs to straddle on an intermediate portion of the mounting track 2 and is releasably fastened to the mounting track 2 with fasteners. When it is desired to move the wire pick-up mechanism 6 and the intermediate clamping mechanism 7, the fasteners that secure the mounting block 81 are released and the mounting block 81 is moved along the mounting track 2 to a desired location, where the fasteners are tightened again to secure the mounting block 81 on the mounting track 2. It is noted that the wire clip 413 of the start-terminal rotation section 41, the wire clamp 72 of the intermediate clamping mechanism 7, the wire clip 423 of the end-terminal rotation section 42, the wire clamp 513 of the start-terminal dragging section 51, and the wire clamp 523 of the slidable dragging section 52 are located on the same vertical plane and the wire clip 413 of the start-terminal rotation section 41, the wire clamp 72 of the intermediate clamping mechanism 7, and the wire clip 423 of the end-terminal rotation section 42 are located on the same horizontal line.

The operation wire cutting and twisting performed by the automatic wire cutting and twisting apparatus 1 according to the present invention will be described with reference to the attached drawings. The operation is divided in four phases simply for easy description and not for limiting the operation.

In phase one, the slidable dragging section 52 moves an end of electrical wires from the wire egress openings 341 to the wire clip 423 of the end-terminal rotation section 42. Specifically, a plurality of electrical wires, which is arranged to juxtapose each other, is fed into the wire ingress openings 321, extends through the wire cutting mechanism 3, and exits from the wire egress openings 341. The elevation cylinder 521 of the slidable dragging section 52 is operated to move the wire clamp 523 upward so as to set the wire clamp 523 on the same horizontal plane as the wire egress openings 341 with the wire clamp 523 being open. Then, the servo motor 536 of the wire dragging mechanism drives the pulleys 535 to rotate and cause, through the timing belt, the slide block 531 to move along the slide track 534 in a direction toward the start-terminal mounting rack 11. When the slide block 531 reaches the start terminal of the slide track 534 (to oppose the start-terminal mounting rack 11), the limit sensors 532 control the servo motor 536 to stop operation, thereby setting the slide block 531 at the start terminal of the slide track 534 with the slidable dragging section 52 that is mounted to the slide block 531 located corresponding to the wire egress openings 341, so that the end of the electrical wires that extends out of the wire egress openings 341 is just received in the wire clamp 523 that is now open. The clamping cylinder 522 of the slidable dragging section 52 is operated to close the wire clamp 523 so as to clamp the end of the electrical wires with the wire clamp 523. The servo motor 536 operates to move the slide block 531 along the slide track 534 in a direction toward the end-terminal mounting rack 12. When the slide block 531 reaches the end terminal of the slide track 534 (opposing the end-terminal mounting rack 12), the limit sensors 532 control the servo motor 536 to stop operation, thereby setting the slide block 531 at the end terminal of the slide track 534 with the slidable dragging section 52 mounted to the slide block 531 located above the wire clip 423 of the end-terminal rotation section 42. Then, the pneumatic cylinder 424 of the end-terminal rotation section 42 operates to open the wire clip 423 and the elevation cylinder 521 of the slidable dragging section 52 returns to move the clamping cylinder 522 and the wire clamp 523 downward, thereby setting the wire clamp 523 on the same horizontal plane as the wire clip 423 of the end-terminal rotation section 42. The wire clamp 523 is positioned next to the wire clip 423 and the electrical wires clamped by the wire clamp 523 are received in the open wire clip 423. The pneumatic cylinder 424 returns to close the wire clip 423 and the clamping cylinder 522 returns to open the wire clamp 523. The elevation cylinder 521 then operates to move the wire clamp 523 upward so that the wire clip 423 holds the end of the electrical wires.

In phase two, the wire cutting mechanism 3 cuts off the electrical wires and the start-terminal dragging section 51 moves an opposite end of the electrical wires to the wire clip 413 of the start-terminal rotation section 41. Specifically, the elevation cylinder 511 of the start-terminal dragging section 51 operates to move the wire clamp 513 upward to the horizontal plane where the wire egress openings 341 are located for receiving the electrical wires that are held between the wire egress openings 341 and the wire clip 423 into the wire clamp 513 that is now open. The clamping cylinder 512 operates to close the wire clamp 513 so that the wire clamp 513 clamps the electrical wires at a location close to the wire egress openings 341. The first extension pneumatic cylinder 31 and the second extension pneumatic cylinder 33 of the wire cutting mechanism 41 respectively drive the first cutter block 32 and the second cutter block 34 in opposite directions so as to cut off the electrical wires between the wire ingress openings 321 and the wire egress openings 341. The pneumatic cylinder 414 of the start-terminal rotation section 41 operates to open the wire clip 413. The elevation cylinder 511 returns to move the wire clamp 513 downward to the horizontal plane where the wire clip 413 of the start-terminal rotation section 41 is located. The wire clamp 513 is positioned next to the wire clip 413 and electrical wires clamped in the wire clamp 513 are received, at an end thereof, into the open wire clip 413. The pneumatic cylinder 414 returns to close the wire clip 413 and the clamping cylinder 512 returns to open the wire clamp 513. The end of the electrical wires is now held in the wire clip 413.

In phase three, the wire twisting mechanism 4 twists the electrical wires together. Specifically, the opposite ends of the electrical wires are now respectively held by the wire clips 413, 423 of the start-terminal rotation section 41 and the end-terminal rotation section 42. The driving portions 411, 421 of the start-terminal rotation section 41 and the end-terminal rotation section 42 are operated in opposite directions to respectively drive the rotation arm 412 and the rotation arm 422 to rotate in opposite directions. The wire clips 413, 423 that are mounted to the rotation arms 412, 422 respectively are now rotated in opposite directions so that the two ends of the electrical wires held by the wire clips 413, 423 are caused to rotate in opposite directions to have the electrical wires twisted together thereby accomplishing the twisting operation.

In phase four, the wire pick-up mechanism 6 picks up and moves the twisted wires to a desired position. Specifically, the turn-over pneumatic cylinder 61 of the wire pick-up mechanism 6 is in a returned condition, whereby the turn-over arm 62 is straightforward expanded to position the electrical wires clamped between the start-terminal rotation section 41 and the end-terminal rotation section 42 above the wire pick-up zone of the wire pick-up bars 65 (between the stop board 64 and the stop blocks 66). The pneumatic cylinders 414, 424 of the start-terminal rotation section 41 and the end-terminal rotation section 42 operate to open the wire clips 413, 423 so that the twisted wires are allowed to fall onto the wire pick-up zone of the wire pick-up bars 65. The turn-over pneumatic cylinder 61 of the wire pick-up mechanism 6 operates to drive a 90 degree turning of the turn-over arm 62, and the turn-over arm 62 drives the two wire pick-up bars 65 to turn upwards by 90 degrees to convey the twisted wires to a desired position.

Under certain conditions, electrical wires require only partial twisting, such as only one half of the length of the electrical wires needing to be twisted. In such conditions, the twisting operation can be carried out in such a way that phases one, two, and four are exactly the same as those described above, but phase three is modified, where with two ends of the electrical wires being held by the wire clips 413, 423 of the start-terminal rotation section 41 and the end-terminal rotation section 42 and an intermediate portion of the electrical wires located within the wire clamp 72 of the intermediate clamping mechanism 7, which is now open, the clamping cylinder 71 is operated to close the wire clamp 72 and thus clamped the intermediate portion of the electrical wires in the wire clamp 72. The driving portion 411 of the start-terminal rotation section 41, or the driving portion 421 of the end-terminal rotation section 42, is made operating to drive rotation of the rotation arm 412 or the rotation arm 422, which in turn rotates the wire clip 413 or 423, whereby one of the ends of the electrical wires held by the wire clip 413 and the wire clip 423 is caused to rotate to thereby twist the electrical wires between the end of the wires and the intermediate portion of the wires to complete the twisting operation.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An automatic wire cutting and twisting apparatus, which is adapted to cut and twist wires, comprising:

a chassis board, on which a start-terminal mounting rack, an end-terminal mounting rack, and a mounting track are mounted, the mounting track being fixed on the chassis board, the start-terminal mounting rack being fixed to the chassis board to oppose a start terminal of the mounting track, the end-terminal mounting rack being coupled to an end terminal of the mounting track in a position adjustable manner;

a wire cutting mechanism, which is mounted on the start-terminal mounting rack and forms wire ingress openings and wire egress openings;

a wire twisting mechanism, which comprises a start-terminal rotation section and an end-terminal rotation section, the start-terminal rotation section being mounted on the start-terminal mounting rack, the end-terminal rotation section being mounted on the end-terminal mounting rack;

a wire dragging mechanism, with a start-terminal dragging section and a slidable dragging section, the start-terminal dragging section being mounted on the chassis board between the start terminal of the mounting track and the start-terminal mounting rack, the slidable dragging section being slidably coupled to the chassis board to be movable above the mounting track;

a wire pick-up mechanism, which is mounted on the mounting track in a position adjustable manner and located between the start-terminal rotation section and the end-terminal rotation section; and a cutting and twisting control mechanism, which is electrically connected to the wire cutting mechanism, the wire twisting mechanism, and the wire dragging mechanism to control the wire cutting mechanism, the wire twisting mechanism, and the wire dragging mechanism.

2. The automatic wire cutting and twisting apparatus as claimed in claim 1, wherein the start-terminal rotation section comprises a structure comprising a driving portion, a rotation arm, a wire clip, and a pneumatic cylinder, the driving portion being coupled to an end of the rotation arm for driving rotation of the rotation arm, the wire clip being mounted to an opposite end of the rotation arm, the pneumatic cylinder being coupled to the wire clip for controlling the wire clip to selectively open and close, the end-terminal rotation section comprising a structure similar to the structure of the start-terminal rotation section.

3. The automatic wire cutting and twisting apparatus as claimed in claim 1, wherein the wire pick-up mechanism comprises a mounting block, a turn-over pneumatic cylinder, a turn-over arm, a fixing block, a stop board, two stop blocks, and two wire pick-up bars, the mounting block being mounted on the mounting track in a position adjustable manner, the turn-over pneumatic cylinder being fixed to the mounting block and coupled to an end of the turn-over arm for selectively turning the turn-over arm by a predetermined angle, the fixing block being arranged at an opposite end of the turn-over arm, the two wire pick-up bars being mounted, at one end thereof, to opposite side portions of the fixing block and extending, at an opposite end, across the mounting track, the two stop blocks being respectively coupled to the wire pick-up bars at the ends thereof distant from the fixing block, the stop board being fixed to the wire pick-up bars at a location close to the fixing block.

4. The automatic wire cutting and twisting apparatus as claimed in claim 1, wherein the start-terminal dragging section comprises a structure comprising a clamping cylinder, an elevation cylinder, and a wire clamp, the elevation cylinder comprising an elevation body and an elevation arm, the clamping cylinder comprising a clamping body and a clamping arm, the elevation body being fixed to the chassis board, the clamping body being attached to the elevation arm, the wire clamp being mounted to the clamping arm, the slidable dragging section comprising a structure similar to the structure of the start-terminal dragging section.

5. The automatic wire cutting and twisting apparatus as claimed in claim 4, wherein the wire dragging mechanism comprises a slide block, a servo motor, a slide track, a timing belt, and pulleys, the elevation body of the slidable dragging section being mounted to the slide block, which is slidably mounted to the slide track, the slide track being fixed to the chassis board and substantially parallel to the mounting track, opposite ends of the slide track being respectively provided with the pulleys with the timing belt surrounding the pulleys, the timing belt being coupled to the slide block for driving the slide block to slide along the slide track.

6. The automatic wire cutting and twisting apparatus as claimed in claim 5, wherein the slide track has opposite ends at which limit sensors are respectively arranged, a home-position sensor being further arranged between the limit sensors.

7. The automatic wire cutting and twisting apparatus as claimed in claim 1, wherein the wire cutting mechanism comprises a first cutter block, a second cutter block, a first extension pneumatic cylinder, and a second extension pneumatic cylinder, the first cutter block and the second cutter block being arranged to juxtapose each other and mounted on the start-terminal mounting rack, the first cutter block forming the wire ingress openings, the second cutter block forming the wire egress openings, the first extension pneumatic cylinder being coupled to the first cutter block for controlling movement of the first cutter block, the second extension pneumatic cylinder being coupled to the second cutter block for controlling movement of the second cutter block.

8. The automatic wire cutting and twisting apparatus as claimed in claim 1 further comprising an intermediate clamping mechanism, which a clamping cylinder and a wire clamp, the clamping cylinder comprising a clamping body and a clamping arm, the clamping body being mounted on the mounting track and coupled to the wire pick-up mechanism, the clamping arm being coupled to the wire clamp for controlling operation of the wire clamp.

* * * * *